US010542339B1

(12) United States Patent
Ruth

(10) Patent No.: US 10,542,339 B1
(45) Date of Patent: Jan. 21, 2020

(54) MOUTH COVER RADIO HEADSET

(71) Applicant: Ysidron Ruth, Leesvurg, GA (US)

(72) Inventor: Ysidron Ruth, Leesvurg, GA (US)

( * ) Notice: Subject to any disclaimer, the term of this patent is extended or adjusted under 35 U.S.C. 154(b) by 0 days.

(21) Appl. No.: 16/385,553

(22) Filed: Apr. 16, 2019

(51) Int. Cl.
*H04R 1/08* (2006.01)
*H04R 1/10* (2006.01)

(52) U.S. Cl.
CPC ..... *H04R 1/08* (2013.01); *H04R 1/1091* (2013.01)

(58) Field of Classification Search
CPC ..... H04R 1/086
See application file for complete search history.

(56) References Cited

U.S. PATENT DOCUMENTS 2,079,099 A * 5/1937 Barnett ..... A45D 44/12 2/174
6,935,458 B2 * 8/2005 Owens ..... H04R 1/086 181/205
7,103,318 B2 * 9/2006 Levinsohn ..... G09F 9/35 455/41.2
7,599,486 B1 * 10/2009 Rivas ..... H04R 1/08 379/433.01
8,434,493 B1 * 5/2013 McGhie ..... A41D 13/1161 128/200.24
8,437,491 B2 * 5/2013 Ward ..... H04R 1/083 381/355
8,996,382 B2 * 3/2015 McClung, III ..... H04R 1/083 704/226
9,241,208 B2 * 1/2016 Ball ..... H04R 1/086
D792,377 S 7/2017 Humphreys
10,349,159 B2 * 7/2019 Pruitt ..... H04R 1/1091
2008/0134402 A1 * 6/2008 Bailey ..... A63B 71/10 2/9
2008/0304690 A1 * 12/2008 Poindexter ..... H04R 1/08 381/375
2010/0034412 A1 * 2/2010 Parda ..... H04R 1/086 381/355
2013/0174381 A1 * 7/2013 McClellan ..... H04R 1/086 24/3.12
2015/0182765 A1 * 7/2015 Saco ..... A41D 13/1161 128/863
2016/0255432 A1 * 9/2016 Casso Villareal ..... H04R 1/105 381/375
2016/0261940 A1 9/2016 McClung, III
2016/0293065 A1 * 10/2016 Cunningham, Sr. .... G09F 21/02
2017/0070798 A1 * 3/2017 Arnold ..... A63B 71/02

FOREIGN PATENT DOCUMENTS

WO WO2009029667 3/2009

* cited by examiner

*Primary Examiner* — Matthew A Eason

(57) ABSTRACT

A mouth cover radio headset for shielding a user's mouth from lip reading includes a headset comprising an ear cover and a flexible band coupled to the ear cover. The flexible band has a top pad and a side pad coupled to a distal end. A radio unit is coupled within the ear cover and comprises a transceiver and a battery. A speaker is coupled within the ear cover and is in operational communication with the radio unit. A boom is coupled to the headset and pivotably extends from the ear cover. An expandable mouth shield is coupled to the boom. The expandable mouth shield has a closed position and an alternate expanded position. The expandable mouth shield is configured to cover a wearer's mouth when in the expanded position. A microphone is coupled to the expandable mouth shield and is in operational communication with the radio unit.

11 Claims, 6 Drawing Sheets

MOUTH COVER RADIO HEADSET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to radio headsets and more particularly pertains to a new radio headset for shielding a user's mouth from lip reading.

BRIEF SUMMARY OF THE INVENTION

An embodiment of the disclosure meets the needs presented above by generally comprising a headset comprising an ear cover and a flexible band coupled to the ear cover. The flexible band has a top pad and a side pad coupled to a distal end. A radio unit is coupled within the ear cover and comprises a transceiver and a battery. A speaker is coupled within the ear cover and is in operational communication with the radio unit. A boom is coupled to the headset and pivotably extends from the ear cover. An expandable mouth shield is coupled to the boom. The expandable mouth shield has a closed position and an alternate expanded position. The expandable mouth shield is configured to cover a wearer's mouth when in the expanded position. A microphone is coupled to the expandable mouth shield and is in operational communication with the radio unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
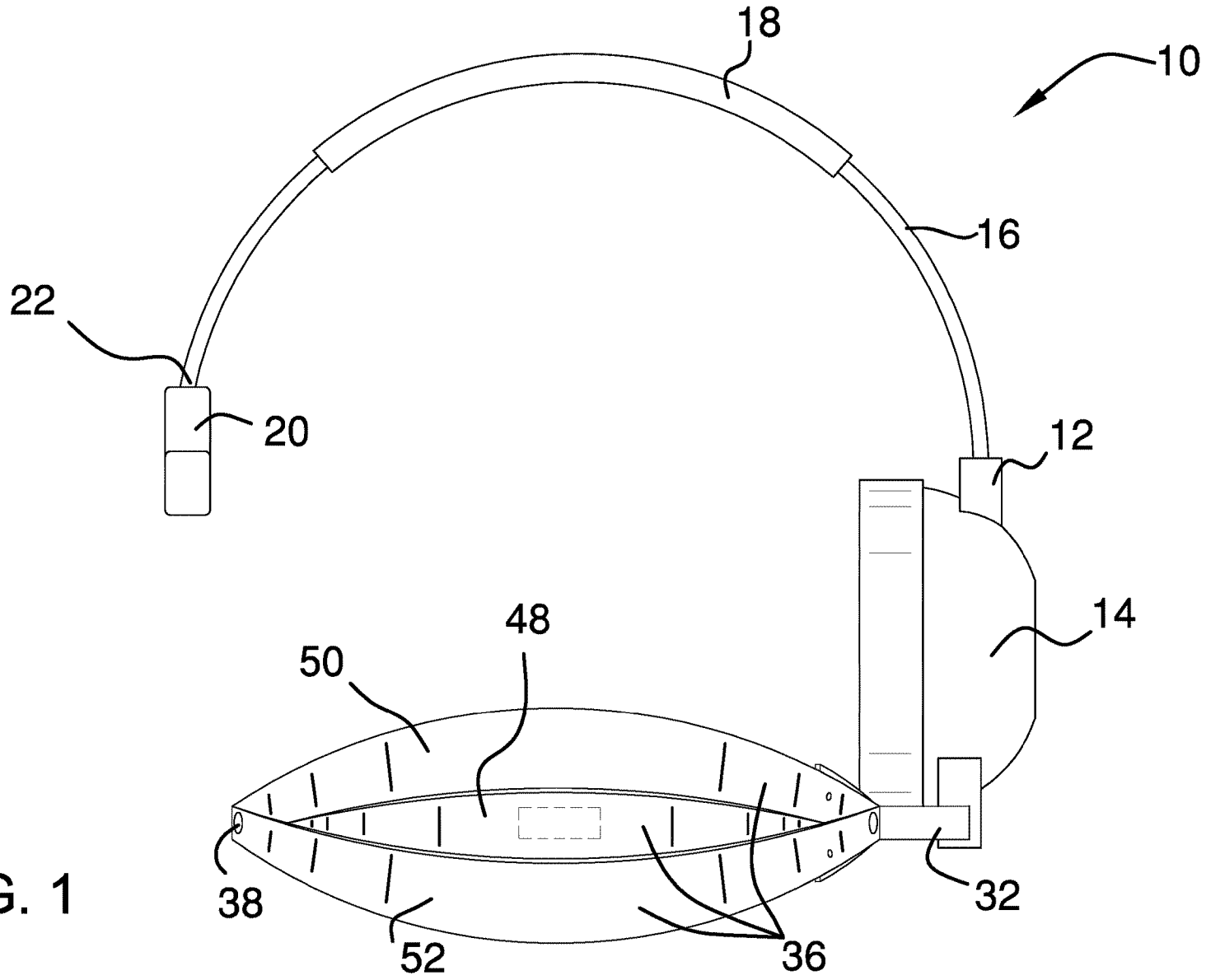
FIG. 1 is a front elevation view of a mouth cover radio headset according to an embodiment of the disclosure.

With reference now to the drawings, and in particular to FIGS. 1 through 6 thereof, a new radio headset embodying the principles and concepts of an embodiment of the disclosure and generally designated by the reference numeral 10 will be described.

As best illustrated in FIGS. 1 through 6, the mouth cover radio headset 10 generally comprises a headset 12 comprising an ear cover 14 and a flexible band 16 coupled to the ear cover 14. The flexible band 16 has a top pad 18 and a side pad 20 coupled to a distal end 22 to secure the ear cover 14 to a user's head. The side pad 20 may be an inverted T-shape to comfortably increase the surface contact area with the user's head. A radio unit 24 is coupled within the ear cover 14 and comprises a transceiver 26 and a battery 28. A speaker 30 is coupled within the ear cover 14 and is in operational communication with the radio unit 24. A boom 32 is coupled to the headset 12 and pivotably extends from the ear cover 14.

Figure 2:
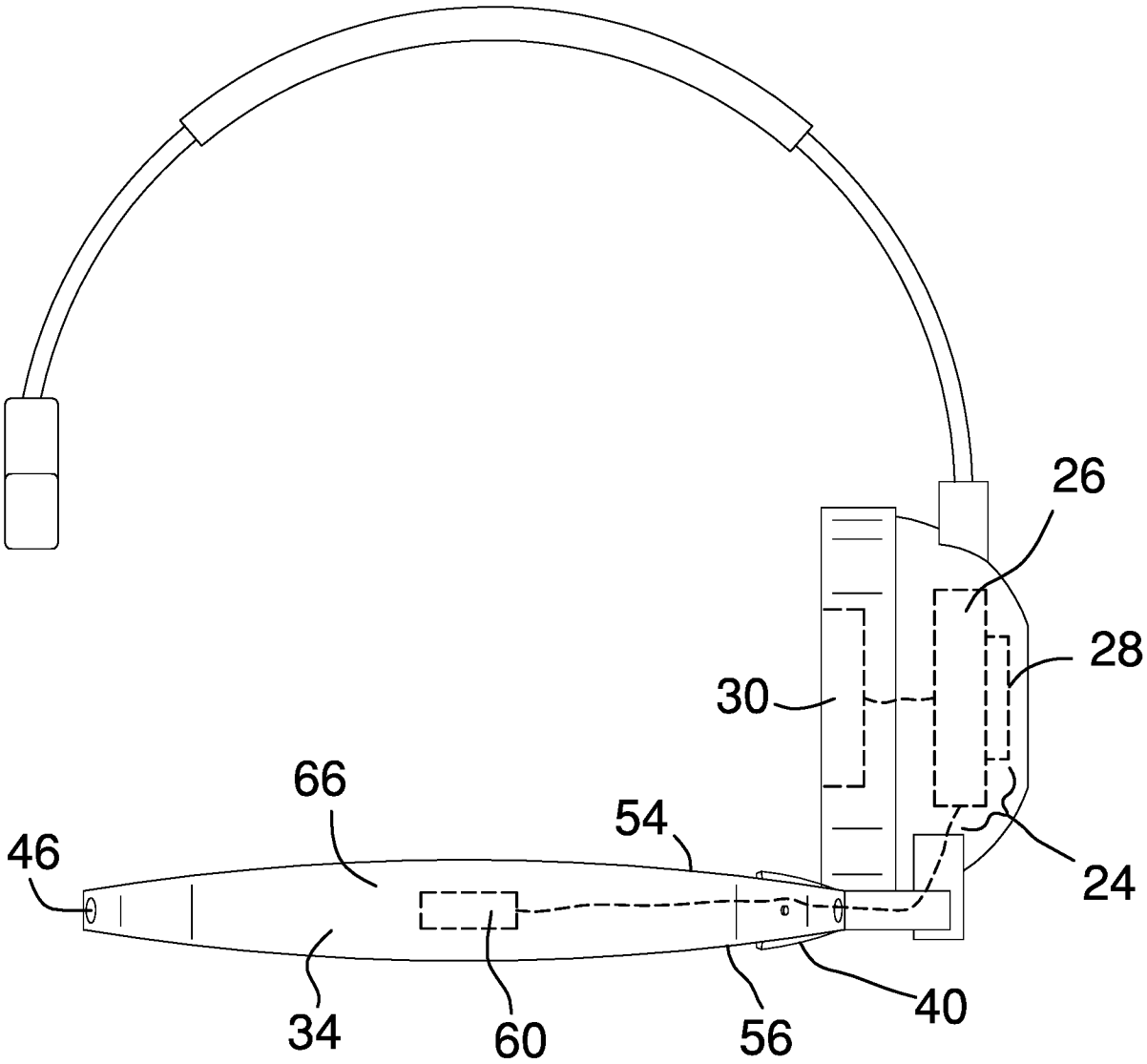
FIG. 2 is a front elevation view of an embodiment of the disclosure.
Figure 3:
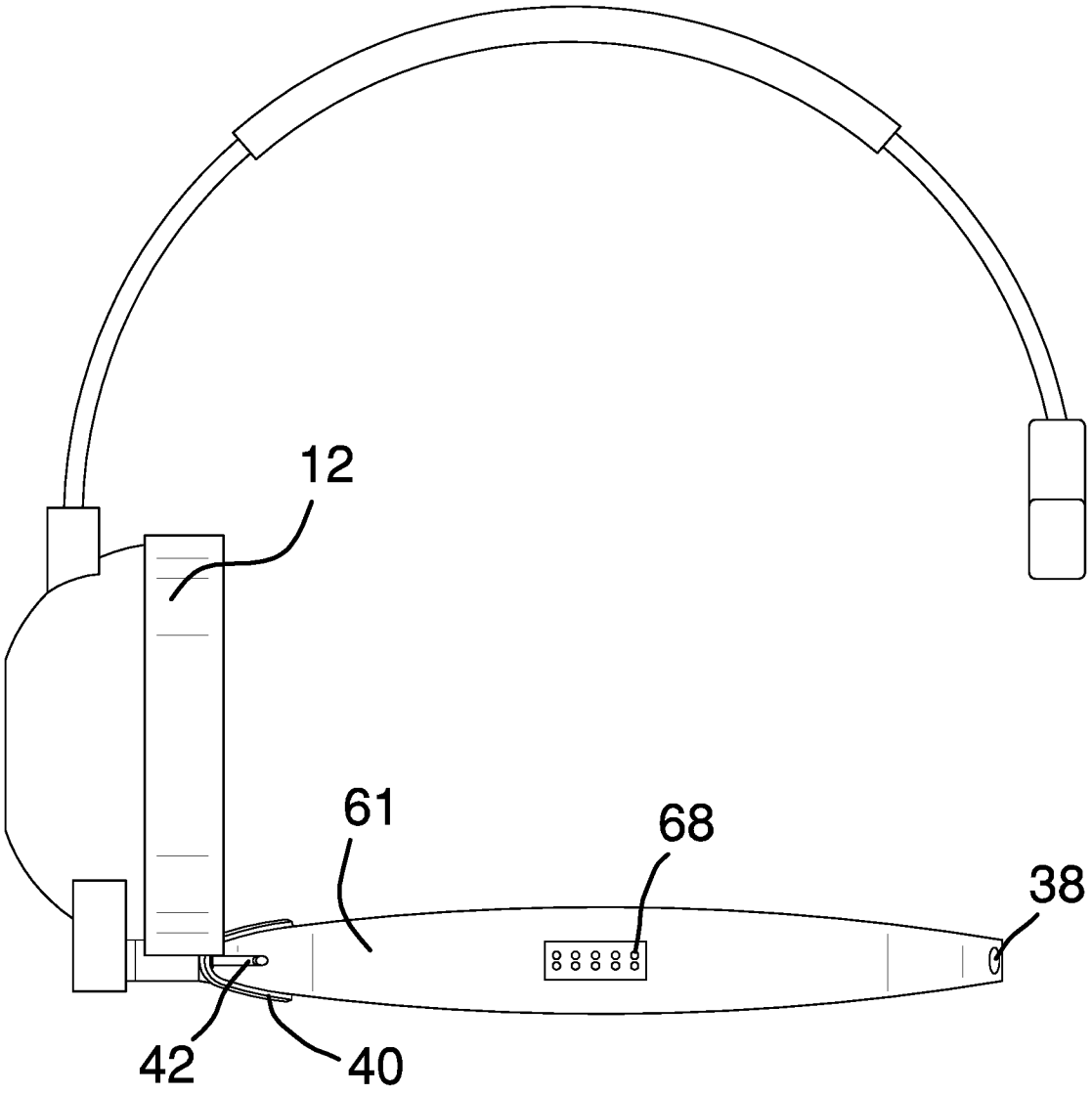
FIG. 3 is a rear elevation view of an embodiment of the disclosure.
Figure 4:
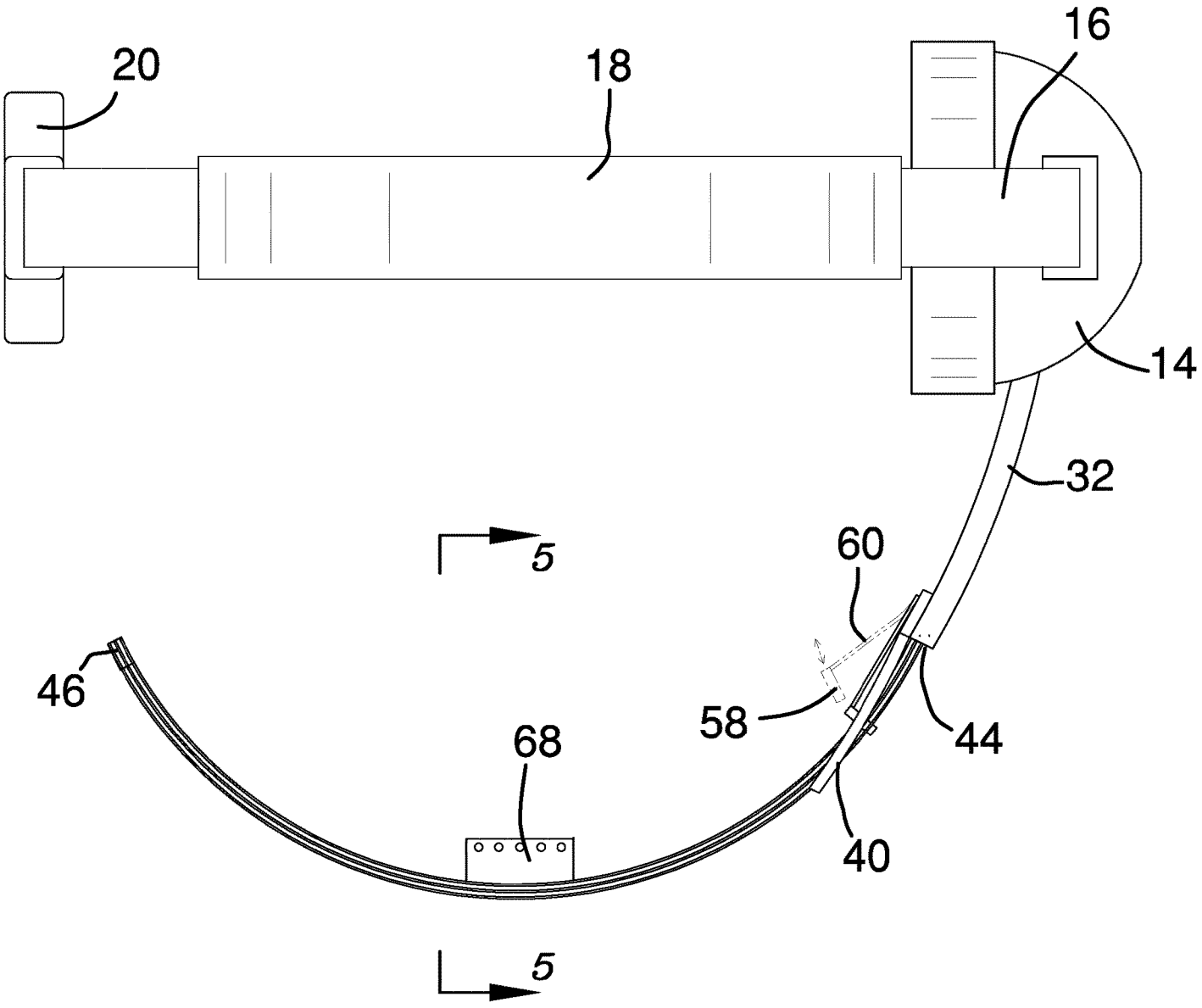
FIG. 4 is a top plan view of an embodiment of the disclosure.
Figure 5:
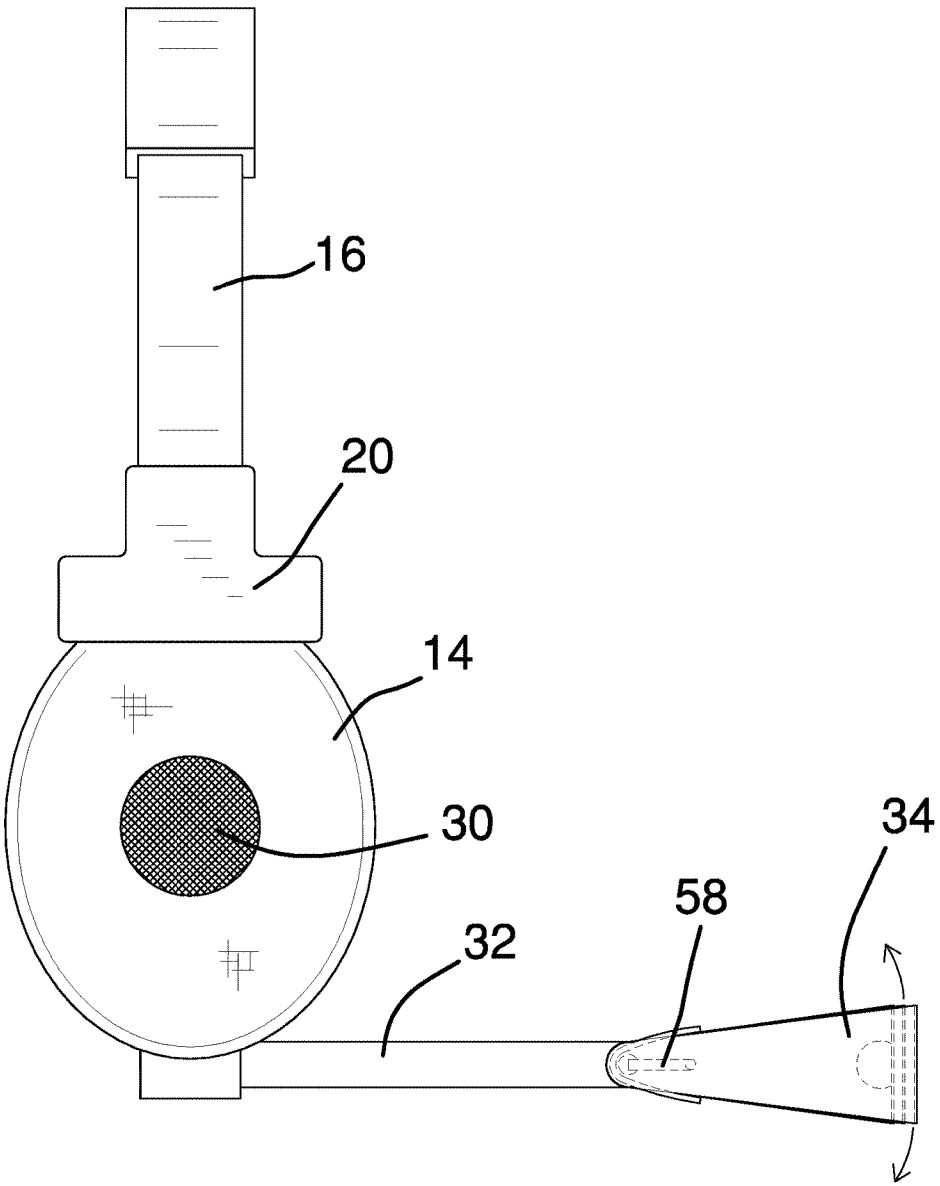
FIG. 5 is a side elevation view of an embodiment of the disclosure.
Figure 6:
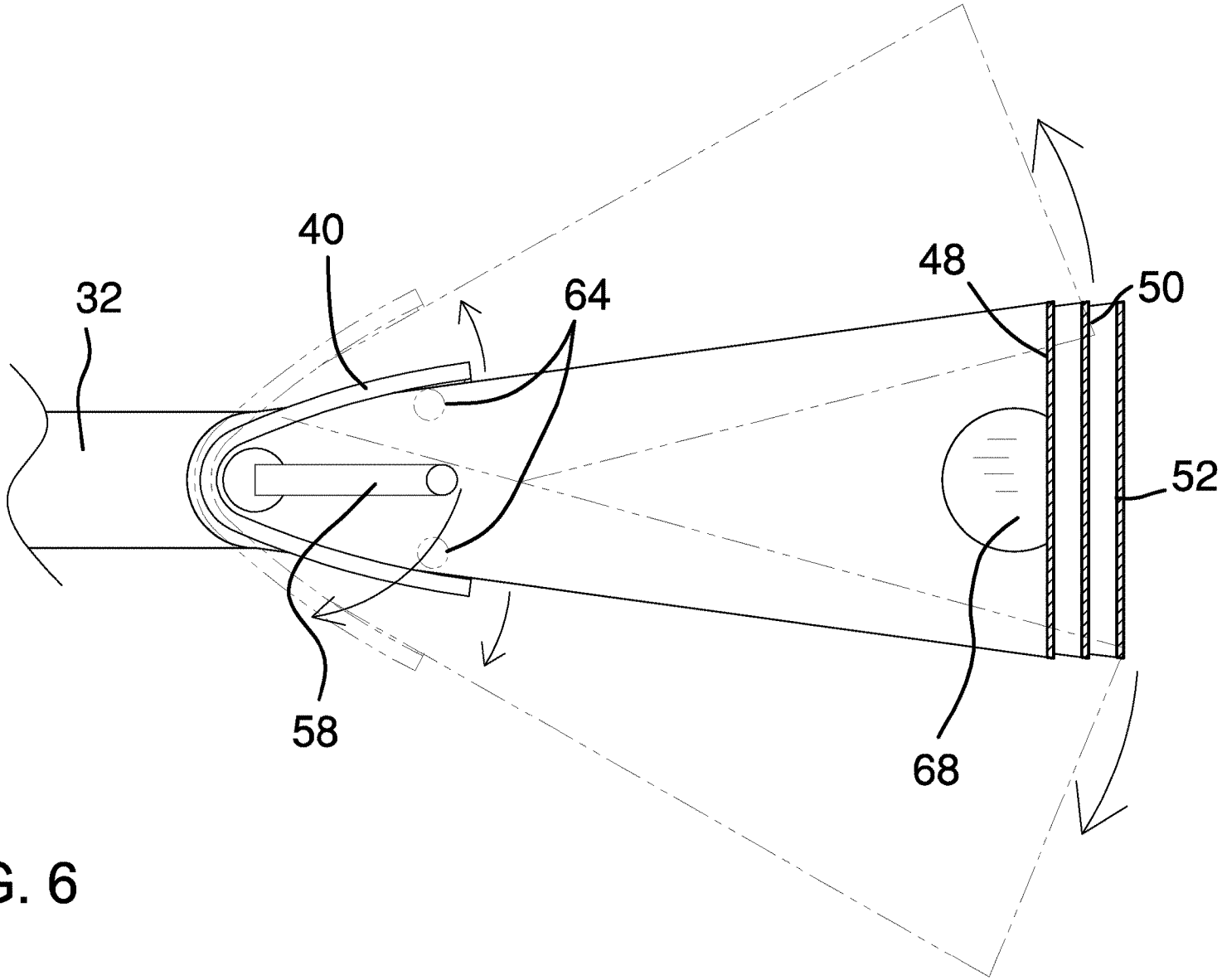
FIG. 6 is a cross-sectional view of an embodiment of the disclosure along line 6-6 of FIG. 4.

An expandable mouth shield 34 is coupled to the boom 32. The expandable mouth shield 34 has a closed position (as shown in FIGS. 2 and 3) and an alternate expanded position (as shown in FIG. 1). The expandable mouth shield 34 is configured to cover a wearer's mouth when in the expanded position to prevent lip reading, particularly when used in televised sporting events that typically require coaches to cover their mouths with their hands or play books. The expandable mouth shield 34 comprises a plurality of panels 36, a hinge 38, a panel spring 40, and a holding mechanism 42.

Each of the plurality of panels 36 has a parabolic profile, a boom end 44, and a free end 46. The plurality of panels 36 comprises a fixed panel 48, at least one upper panel 50, and at least one lower panel 52. The boom end 44 of each of the upper panel 50 and the lower panel 52 is hingingly coupled to the boom 32 and the boom end 44 of the fixed panel 48 is rigidly coupled to the boom 32. The fixed panel 48 is the innermost panel of the plurality of panels 36 to maintain its position in front of the user's mouth. Each of the plurality of panels 36 overlaps in the closed position, while the upper panel 50 extends above the fixed panel 48 and the lower panel 52 extends below the fixed panel 48 in the expanded position.

The hinge 38 is coupled to the free end 46 of each of the plurality of panels to create a clamshell style movement when the plurality of panels 36 moves between the closed position and the expanded position. The panel spring 40 is coupled to the plurality of panels 36 to move the plurality of panels to the expanded position. The panel spring 40 may be parabolic, coupled around the boom end 44 of each of the plurality of panels and to an upper edge 54 of the upper panel 50 and to a lower edge 56 of the lower panel 52. The holding mechanism 42 may be a spring pin 58 comprising a spring arm 60 coupled to an inside face 61 of the fixed panel 48 and an engagement pin 62 coupled to the spring arm 60. The holding mechanism 42 has an engaged position selectively engaging each of the plurality of panels 36 to secure the closed position and an alternate released position allowing the panel spring 40 to move the plurality of panels 36 to the expanded position. The engagement pin 62 is selectively engageable within a pin aperture 64 extending through each of the plurality of panels 36. The spring pin 58 is configured and arranged to automatically engage each of the pin apertures 64 with the plurality of panels 36 in the closed position. The spring pin 58 is manually disengageable by pushing the engagement pin 62 from an outside face 66 of the outermost panel of the plurality of panels 36. A microphone 68 is coupled to the inside face 62 of the fixed panel 48 and is in operational communication with the radio unit 24.

In use, the headset 12 is worn and operated like a traditional radio. When desired, the engagement pin 62 is pushed to release the plurality of panels 36 from the closed position to the expanded position, thus shielding the user's mouth from lip readers. The upper panel 50 and the lower panel 52 may then be squeezed back together, at which point the spring pin 58 reengages the pin aperture 64 of each of the plurality of panels 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mouth cover radio headset comprising:

a headset, the headset comprising an ear cover and a flexible band coupled to the ear cover, the flexible band having a top pad and a side pad coupled to a distal end;

a radio unit coupled to the headset, the radio unit being coupled within the ear cover and comprising a transceiver and a battery;

a speaker coupled to the headset, the speaker being coupled within the ear cover and in operational communication with the radio unit;

a boom coupled to the headset, the boom pivotably extending from the ear cover;

an expandable mouth shield coupled to the boom, the expandable mouth shield having a closed position and an alternate expanded position, the expandable mouth shield being configured to cover a wearer's mouth when in the expanded position; and a microphone coupled to the expandable mouth shield, the microphone being in operational communication with the radio unit.

2. The mouth cover radio headset of claim 1 wherein the expandable mouth shield comprises:

a plurality of panels coupled to the boom, each of the plurality of panels having a boom end and a free end, the plurality of panels comprising a fixed panel, at least one upper panel, and at least one lower panel, the boom end of each of the upper panel and the lower panel being hingingly coupled to the boom and the boom end of the fixed panel being rigidly coupled to the boom, each of the plurality of panels overlapping in the closed position, the upper panel extending above the fixed panel and the lower panel extending below the fixed panel in the expanded position;

a panel spring coupled to the plurality of panels, the panel spring moving the plurality of panels to the expanded position; and a holding mechanism coupled to the plurality of panels, the holding mechanism having an engaged position selectively engaging each of the plurality of panels to secure the closed position and an alternate released position allowing the panel spring to move the plurality of panels to the expanded position.

3. The mouth cover radio headset of claim 2 wherein the holding mechanism is a spring pin comprising a spring arm coupled to an inside face of the fixed panel and an engagement pin coupled to the spring arm, the engagement pin being selectively engageable within a pin aperture extending through each of the plurality of panels, the spring pin being configured and arranged to automatically engage each of the pin apertures with the plurality of panels in the closed position, the spring pin being manually disengageable by pushing from an outside face of the outermost panel of the plurality of panels.

4. The mouth cover radio headset of claim 2 further comprising the panel spring being parabolic, the panel spring being coupled around the boom end of each of the plurality of panels and to an upper edge of the upper panel and to a lower edge of the lower panel.

5. The mouth cover radio headset of claim 2 further comprising each of the plurality of panels having a parabolic profile.

6. The mouth cover radio headset of claim 2 further comprising the fixed panel being the innermost panel of the plurality of panels.

7. The mouth cover radio headset of claim 6 further comprising the microphone being coupled to the fixed panel.

8. The mouth cover radio headset of claim 2 further comprising the at least one upper panel and the at least one lower panel each being one panel.

9. The mouth cover radio headset of claim 2 further comprising a hinge coupled to the free end of each of the plurality of panels.

10. The mouth cover radio headset of claim 1 further comprising the side pad being an inverted T-shape.

11. A mouth cover radio headset comprising:

a headset, the headset comprising an ear cover and a flexible band coupled to the ear cover, the flexible band having a top pad and a side pad coupled to a distal end, the side pad being an inverted T-shape;

a radio unit coupled to the headset, the radio unit being coupled within the ear cover and comprising a transceiver and a battery;

a speaker coupled to the headset, the speaker being coupled within the ear cover and in operational communication with the radio unit;

a boom coupled to the headset, the boom pivotably extending from the ear cover;

an expandable mouth shield coupled to the boom, the expandable mouth shield having a closed position and an alternate expanded position, the expandable mouth shield being configured to cover a wearer's mouth when in the expanded position, the expandable mouth shield comprising:

a plurality of panels coupled to the boom, each of the plurality of panels having a parabolic profile, a boom end, and a free end, the plurality of panels comprising a fixed panel, at least one upper panel, and at least one lower panel, the boom end of each of the upper panel and the lower panel being hingingly coupled to the boom and the boom end of the fixed panel being rigidly coupled to the boom, the fixed panel being the innermost panel of the plurality of panels, each of the plurality of panels overlapping in the closed position, the upper panel extending above the fixed panel and the lower panel extending below the fixed panel in the expanded position;

a hinge coupled to the plurality of panels, the hinge being coupled to the free end of each of the plurality of panels;

a panel spring coupled to the plurality of panels, the panel spring moving the plurality of panels to the expanded position, the panel spring being parabolic and coupled around the boom end of each of the plurality of panels and to an upper edge of the upper panel and to a lower edge of the lower panel; and a holding mechanism coupled to the plurality of panels, the holding mechanism having an engaged position selectively engaging each of the plurality of panels to secure the closed position and an alternate released position allowing the panel spring to move the plurality of panels to the expanded position;

the holding mechanism being a spring pin comprising a spring arm coupled to an inside face of the fixed panel and an engagement pin coupled to the spring arm, the engagement pin being selectively engageable within a pin aperture extending through each of the plurality of panels, the spring pin being configured and arranged to automatically engage each of the pin apertures with the plurality of panels in the closed position, the spring pin being manually disengageable by pushing from an outside face of the outermost panel of the plurality of panels; and a microphone coupled to the expandable mouth shield, the microphone being coupled to the fixed panel and in operational communication with the radio unit.

* * * * *